US005271214A

United States Patent [19]

Stahlecker et al.

[11] Patent Number: 5,271,214

[45] Date of Patent: Dec. 21, 1993

[54] MULTIPLE SPINNING UNIT SPINNING MACHINE WITH OVERHEAD PLATFORMS SUPPORTING SLIVER CANS AND GUIDING DEVICES FOR SAID SLIVER

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 850,291

[22] Filed: Mar. 12, 1992

[30] Foreign Application Priority Data

Mar. 20, 1991 [DE] Fed. Rep. of Germany ..... 4109022

[51] Int. Cl.[5] ..... D01H 13/04

[52] U.S. Cl. ..... 57/315; 57/90; 57/352

[58] Field of Search ..... 57/75, 90, 352, 315, 57/1 R; 226/171

[56] References Cited

U.S. PATENT DOCUMENTS

| | | | |
|---|---|---|---|
| 317,607 | 5/1885 | Abbot | 57/315 |
| 2,896,269 | 7/1959 | Gardella et al. | 57/315 X |
| 3,191,375 | 6/1965 | Naegeli | 57/315 X |
| 3,312,050 | 4/1967 | Noguera | 57/90 |
| 3,469,385 | 9/1969 | Tsuzuki | 57/90 X |
| 3,564,829 | 2/1971 | Tsuzuki | 57/90 X |
| 3,816,991 | 6/1974 | Takeuchi et al. | 57/90 |

FOREIGN PATENT DOCUMENTS

| | | | |
|---|---|---|---|
| 817572 | 7/1949 | Fed. Rep. of Germany . | |
| 882068 | 7/1953 | Fed. Rep. of Germany | 57/90 |
| 2335740 | 11/1974 | Fed. Rep. of Germany . | |
| 174032 | 7/1991 | Japan | 57/75 |

*Primary Examiner*—Joseph J. Hail, III

*Attorney, Agent, or Firm*—Evenson, McKeown, Edwards & Lenahan

[57] ABSTRACT

In the ease of a spinning machine for the spinning of yarns from slivers which are fed in cans on a platform above the spinning machine, the slivers are conveyed from the cans to the spinning stations by conveyor belts. Several spinning stations are combined to a machine section, and a support is provided between two machine sections respectively on which the guide rollers of the conveyor belt are held. In the area of the center plane of the spinning machine, the support projects upwards through the platform.

23 Claims, 3 Drawing Sheets

MULTIPLE SPINNING UNIT SPINNING MACHINE WITH OVERHEAD PLATFORMS SUPPORTING SLIVER CANS AND GUIDING DEVICES FOR SAID SLIVER

BACKGROUND AND SUMMARY OF THE INVENTION

The invention relates to a spinning machine having spinning stations arranged on both sides of the machine for the spinning of yarns from slivers which are fed to the spinning stations in cans set up in several rows on a platform above the spinning machine. Guiding devices are provided between the cans and the spinning stations which guide the slivers, comprise a delivery device and are at least partly arranged on a support which is held on the spinning machine and extends upwards through the platform in the area of the center plane of the spinning machine.

A spinning machine of this type is known in the field of open-end rotor spinning on the basis of the state of the art of the German Patent Document DE 23 35 740 B2 which corresponds to U.S. Pat. No. 3,816,991. In the case of this spinning machine, the cans are arranged above on a platform and the slivers are fed to the spinning stations through guiding tubes. These guiding tubes, which are provided with baffles, are to serve as intermediate storage devices which are intermittently fed by a continuously running delivery device as a result of a special construction. In this case, the sliver is to be guided through the respective guiding tube essentially without an tensile stress. The guiding tubes, which extend upwards through the platform in the area of the center plane of the spinning machine, are used as supports for the baffles. The known patent text contains nothing concerning the holding of the platform but FIGS. 1 and 2 give the impression that the guiding tubes may be fastened to the platform as well as, in a manner not shown in detail, to the spinning machine.

The feeding of the fiber material in the form of slivers offered in cans is known also in the case of other fast running spinning machines, such as wind-around spinning machines or air spinning machines. As a rule, these are one-sided machines in which the slivers are fed to the spinning stations from above and are taken out of the cans deposited on the rear side of the spinning machine. In this case, guiding devices are provided in the form of rollers and guiding rods for the slivers.

It is also known (German Patent Document DE-PS 817 575) to feed slivers in cans in the case of ring spinning machines, in which case the cans are deposited on platforms or in a space above the spinning machine. In this case, relatively long travelling paths are obtained with one or several vertical sections which lead to the risk that the slivers may hang out, that is, will be drawn uncontrollably because of their own weight. Such an arrangement is therefore possible only for slivers which have a relatively coarse size and therefore a relatively high strength.

However, the spinning of slivers with coarse sizes is very difficult on ring spinning machines. Since the ring spinning machines have only a relatively slow delivery speed at the outlet of the drafting units, taking into account the required drafting, the feeding rollers of the drafting units must rotate very slowly, that is, at rotational speeds of one revolution per minute or less. Technically, it is extremely difficult to let long shafts, like the feeding rollers of drafting units, run at such low rotational speeds with sufficient precision. There is the danger that these shafts rotate only jerkily so that no controlled drafting is obtained. The feeding in cans of the fiber material to be spun has therefore not been carried out successfully in the case of ring spinning machines.

It is an object of the invention to develop a spinning machine of the initially mentioned type in such a manner that fine slivers may also be fed in the cans without the risk of faulty drafting, particularly in vertical sections of the transport path. At the same time, a favorable constructional arrangement of the guiding devices is to be provided.

This object is achieved according to preferred embodiments of the invention in that the delivery device comprises a conveyor belt which guides at least one sliver from the pertaining can to the spinning station, in that several spinning stations are combined to a machine section, and in that a support is provided between two machine sections respectively on which the guiding rollers of the conveyor belt are held.

In the development according to the invention, it is achieved that the slivers are supported and are nevertheless moved into the transport direction. As a result, it becomes possible to also feed relatively thin slivers in cans, that is, slivers of sizes of from approximately Nm 0.4 to 0.8. In this case, these fine slivers may also be conveyed along larger sections in the vertical direction. It is therefore possible to carry out a can feeding operation also in the case of the ring spinning machines because, as a result of the slivers of fine sizes, while taking into account the drafting, the feeding roller pairs of the drafting units still rotate at a sufficiently high speed so that a uniformly round rotating is ensured. Because of this can feeding, it will then be possible to do without a machine such as a flyer connected in front of the ring spinning machines. In the case of other spinning machines, which are provided with drafting units into which slivers are fed, it is possible to feed finer slivers so that the drafting units may then be simplified. For example, there is the possibility in the case of such machines that, instead of five-cylinder drafting units, the three-cylinder drafting units may be used which today are customary in the case of ring spinning machines.

Also in the case of open-end machines, the feeding of finer slivers results in advantages because it reduces the opening-up work for separating the fibers so that the fibers are processed more carefully during the opening-up. It is therefore possible to spin finer yarns with less damaged fibers so that the yarns have a higher quality.

The mounting of the support on the machine has the advantage that the conveyor belts, without any excessive tolerances, are from the start aligned with the pertaining spinning stations. For example, the bending-through of the platform under the weight of the cans has no disadvantageous influence. In addition, it is not required to assign a separate support for the guiding devices to each individual spinning station.

Other objects, advantages and novel features of the present invention will become apparent from the following detailed description of the invention when considered in conjunction with the accompanying drawings.

DETAILED DESCRIPTION OF THE DRAWINGS

Figure 1:
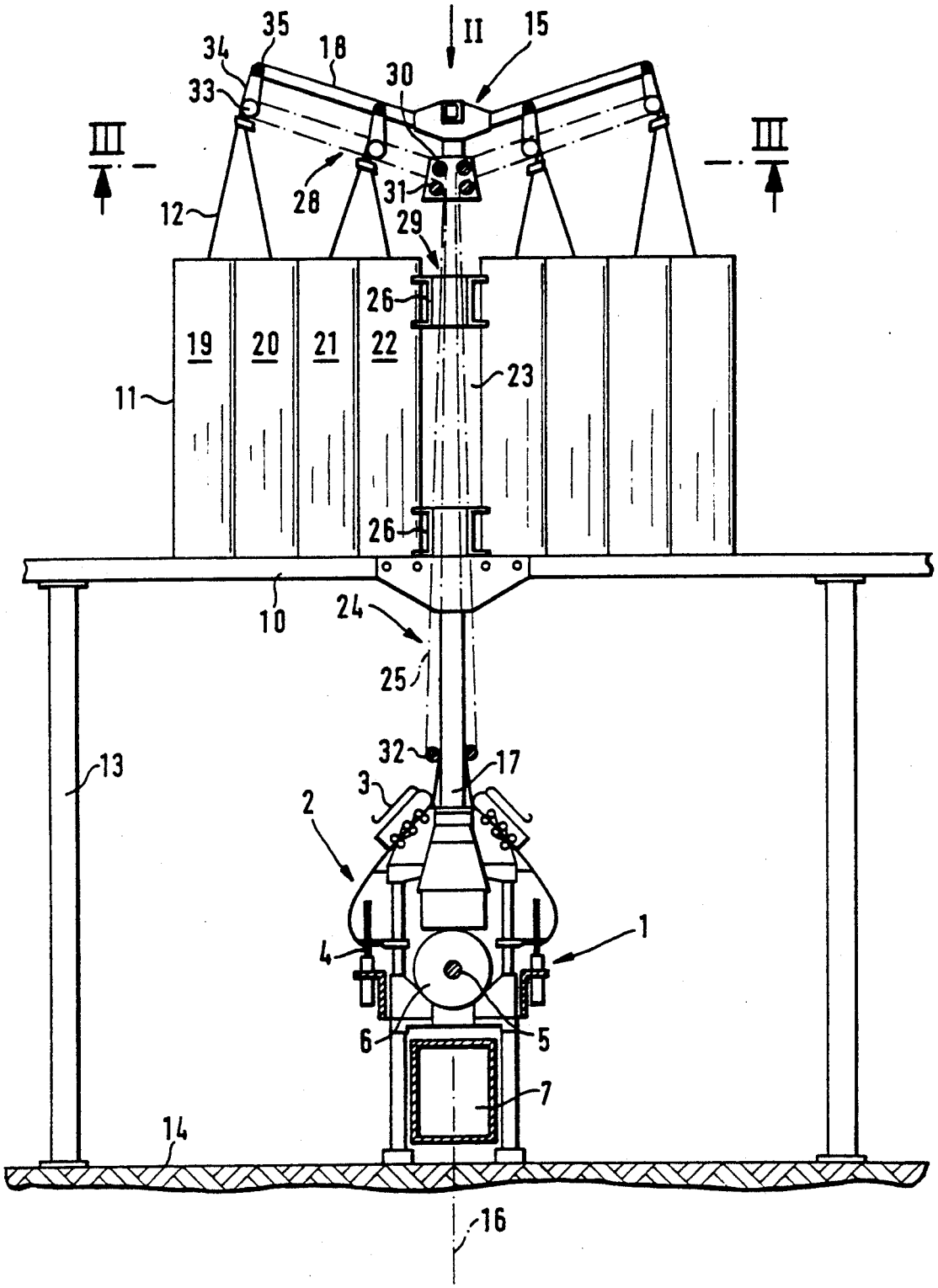
FIG. 1 is a cross-sectional schematic view of a machine system constructed according to a preferred embodiment of the invention having a spinning machine and a platform disposed above it, on which the cans are deposited for the fed sliver, conveyor belts guiding the respective slivers from the cans to the spinning stations.

The invention is particularly suitable for ring spinning machines. FIG. 1 is a schematic drawing of a cross-section of such a ring spinning machine 1. On both sides of the machine, the spinning machine is provided with spinning stations 2 which are arranged in a row next to one another in the longitudinal direction of the ring spinning machine 1.

Of the spinning stations 2, the drafting units 3 and the ring spindles 4 are shown in particular. In addition, a drive shaft 5 is visible which extends through in the longitudinal direction of the machine and which comprises one driving pulley 6 respectively for two or four oppositely disposed spinning stations 2, as well as an air-conditioning duct 7 which is arranged below the drive shaft 5 inside the machine frame and is used for the air-conditioning of the spinning stations 2.

Figure 2:
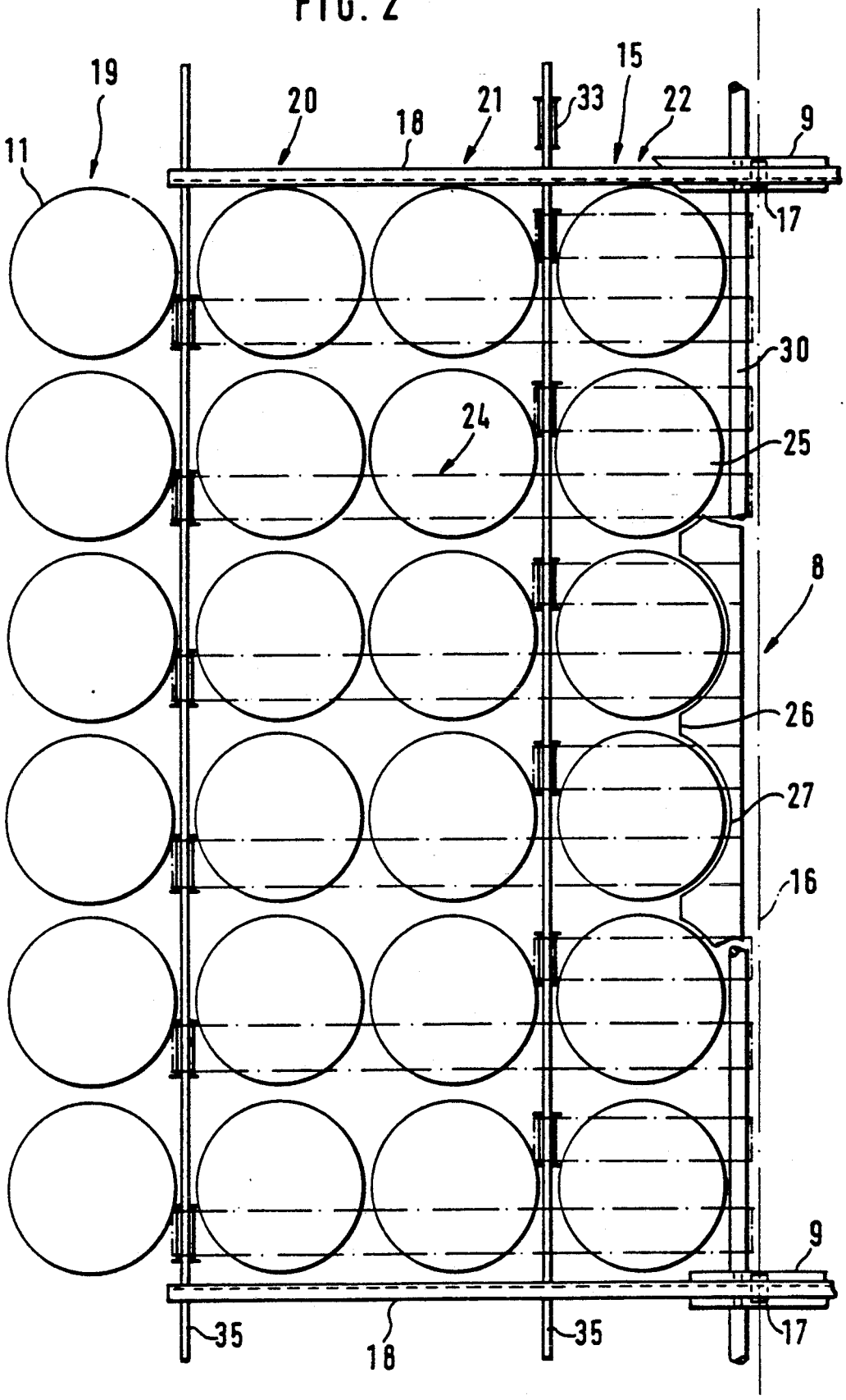
FIG. 2 is a view in the direction of the arrow II of FIG. 1, in which case some structural members, particularly those situated under the platform, were omitted.

As shown, for example, also in FIG. 2, twelve spinning stations 2 respectively are combined to one machine section 8, that is, 24 spinning stations on each side of the machine. The machine sections 8 are bounded by frame walls 9 extending transversely with respect to the ring spinning machine 1.

A platform 10 extends above the ring spinning machine 1 in the longitudinal direction of the machine as well as transversely to it, on which the cans 11 are deposited which contain the slivers 12 to be spun. On both sides of the ring spinning machine 1, at a moderate distance from it, which leaves a clearance for the operating personnel, the platform 10 is supported on the floor 14 by means of supports 13. In addition, the platform lo is supported by means of a support 15 arranged on the ring spinning machine 1. The supports 15 are each fastened to the frame walls 9 following a machine section 8 and are situated in the area of the center plane 16 of the ring spinning machine 1.

As an important structural component, the supports 15 comprise a creel mast 17 following each machine section 8 which is screwed directly on top to the pertaining frame wall 9. Each vertically arranged creel mast 17 has on its upper end, toward each side of the machine, one crossmember 18 respectively, in which case, these crossmembers 18, starting from the creel mast 17, extend in a V-shape upwards and outward. This development makes it possible that the area of the center plane 16 above the platform 10 also becomes easily accessible to the operating personnel without influencing the headroom at a fairly large distance from the creel mast 17.

Four rows 19, 20, 21 and 22 of cans are assigned to each side of the machine. A narrow gap 23 exists between the respective interior rows 22 of both machine sides through which the individual supports 15 are guided.

So that, in the above-described manner, finer slivers 12 than previously can be fed to the spinning stations 2, the slivers 12 are guided between the cans 11 and the spinning stations 2 by means of guiding devices 24. For each side of the machine or for each spinning station 2 respectively or for two spinning stations 2 jointly, the guiding devices 24 comprise a conveyor belt 25 which is indicated by a dash-dotted line. For the protection of these conveyor belts 25, two creel masts 17 respectively are connected with one another by means of a protective plank 26 or two protective planks 26. As shown particularly in FIG. 2, these protective planks 26 at the same time serve as centering devices which are provided with approximately semicylindrical recesses 27 for the cans 11 of the respective interior row 22. As a result, it is possible, also in the area of the conveyor belts 25, to rapidly deposit the cans 11 during an exchange of cans without having to take special care with respect to the guiding devices 24.

The conveyor belts 25 of both sides of the machine, which form the essential part of the guiding devices 24, each have an essentially horizontal section 28 which may also extend slightly diagonally, as well as a vertical section 29. The transition between the sections 28 and 29 is defined by deflecting rollers 30 and 31 which may be called corner rollers and which extend along one machine section 8 respectively. In a manner which will be described in the following, they are disposed in the creel masts 17.

In the area of the drafting units 3 of each machine side, each conveyor belt 25 is guided over a driving roller 32 which extends in the longitudinal direction of the machine and is driven from the direction of the headstock of the ring spinning machine i. The driving roller 32 is used for the drive of the conveyor belts 25, preferably by way of a form closure which is not shown in detail.

Above the cans 11, specifically, in each case, for two rows 19 and 20 as well as 21 and 22 jointly, so-called lift-out rollers 33 are disposed which are at the same time constructed as tension rollers for the conveyor belts 25. These lift-out rollers 33 are freely rotatably disposed on pivoted levers 34 which are resiliently pressed toward the outside. The individual levers 34 are pivotally suspended on so-called creel rods 35 which according to FIG. 2 are preferably jointly assigned to two spinning stations 2 respectively. Two creel rods 35 respectively disposed in crossmembers extend for each side of the machine in the longitudinal direction of the machine. As shown in FIG. 2, the individual conveyor belts 25 have different lengths corresponding to the position of the lift-out rollers 33 and can each guide two slivers 12.

Figure 3:
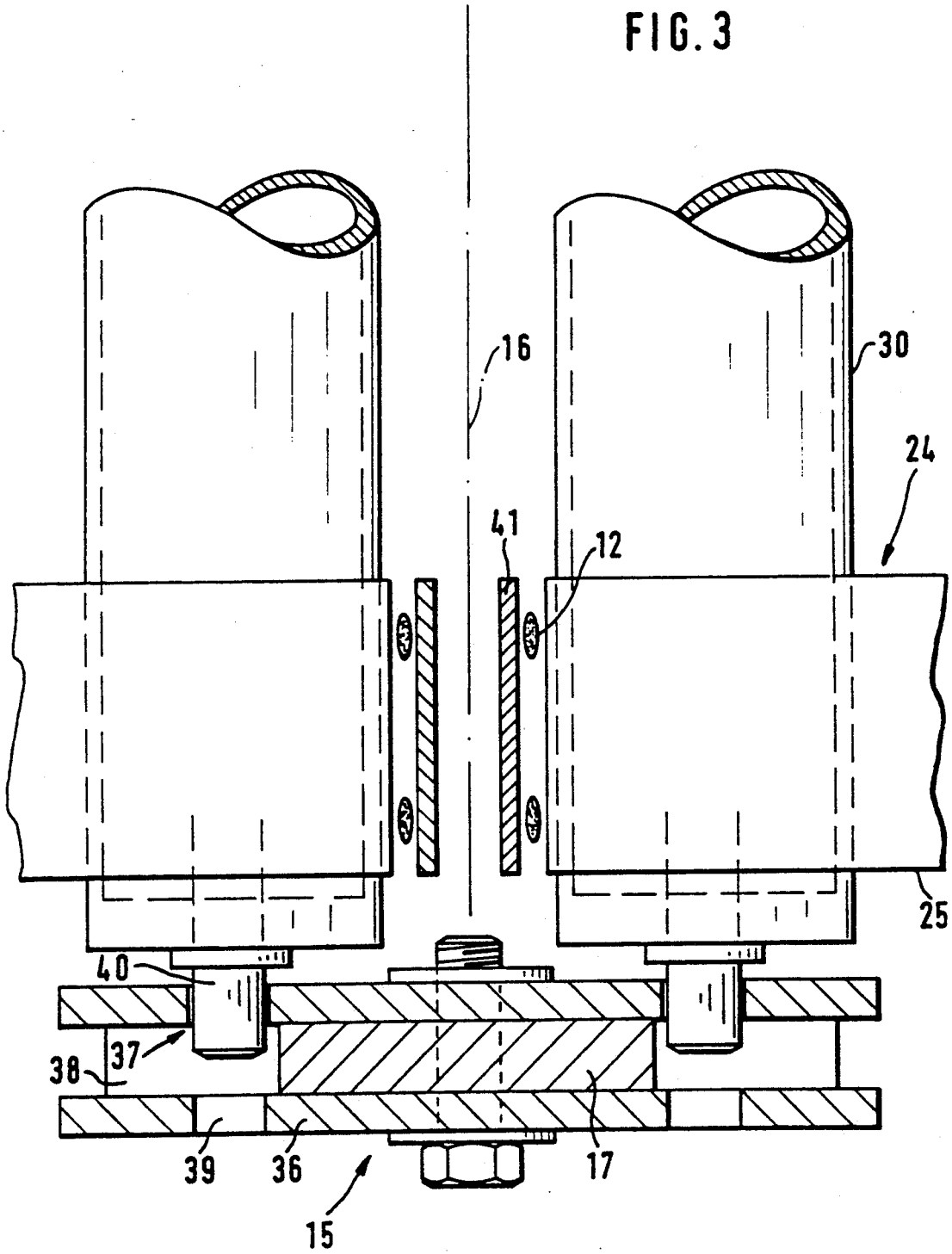
FIG. 3 is an enlarged cross-sectional view along cutting line III—III of FIG. 1.

According to the enlarged sectional view of FIG. 3, the individual creel masts 17 are designed as a full rectangular profile, having the measurements of, for example, 10×80 mm. They are situated precisely in the center plane 16 of the ring spinning machine 1, the narrow side of the rectangle extending in the longitudinal direction of the ring spinning machine 1. Plates 36 are screwed to both long sides of the rectangle. In the area of the bearing points 37 of the deflecting rollers 30, each mast 17 has recesses 38. At this point, the plates 36 are also provided with recesses 39.

The deflecting rollers 30 are constructed as tubes into which ball bearing journals 40 are inserted. These project out of the deflecting rollers 30 and are placed from above in the recesses 39 of the plates 36. The recesses 39 are of a link type. In a similar manner, the deflecting rollers 31 situated below may be placed in lateral links extending diagonally downward.

As also illustrated in FIG. 3, so-called sliding skids 41 are situated in the vertical section 29 between the center plane 16 of the ring spinning machine 1 and the conveyor belt 25. Two slivers 12 are guided side-by-side between the sliding skids 41 and the conveyor belt 25, for each side of the machine. The arrangement of the sliding skids may be constructed according to German Patent Applications P 41 15 459.2, which corresponds to U.S. Pat. Ser. No. 07/874,402, filed May 11, 1992; P 41 09 026.8 (865/40567); P 41 18 947.4, which corresponds to U.S. Pat. Ser. No. 07/895,031, filed Jun. 8, 1992.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine arrangement comprising:

a spinning machine having a plurality of spinning machine sections disposed adjacent one another along a longitudinal extent of the spinning machine, each spinning machine section including a plurality of spinning stations arranged on each of both sides of a spinning machine center plane, a sliver can support platform disposed above the spinning stations, sliver supply cans arranged in a plurality of rows on the platform, and sliver guiding apparatus for guiding sliver between the respective supply cans and spinning stations, wherein said sliver guiding apparatus includes:

respective conveyor belts for guiding at least one sliver from a supply can and a spinning station, support guide rollers for the respective conveyor belts, and at least one support for supporting the support guide rollers, and wherein the at least one support includes a support supported at and extending upwardly from the spinning machine frame through the platform to support the support guide rollers, at a location disposed above the supply cans, said support being disposed between two of said machine sections and serving to support guide rollers for at least one conveyor belt of each of said machine sections, wherein said sliver guiding apparatus further includes respective slides facing respective vertical sections of each conveyor belt with said slides and conveyor belts engaging respective opposite sides of the sliver.

2. A spinning machine arrangement according to claim 1, wherein the two machine sections respectively are connected by a frame wall to which the support is fastened.

3. A spinning machine arrangement according to claim 2, wherein the support has a vertical creel mast, wherein a crossmember is fastened at the upper end of the creel mast which extends in the direction of each machine side, the crossmembers of several creel masts being connected by creel rods extending in the longitudinal direction of the machine.

4. A spinning machine arrangement according to claim 3, wherein guide rollers which are constructed as tension rollers for the conveyor belts are held on the creel rods.

5. A spinning machine arrangement according to claim 1, wherein the support has a vertical creel mast, wherein a crossmember is fastened at the upper end of the creel mast which extends in the direction of each machine side, the crossmembers of several creel masts being connected by creel rods extending in the longitudinal direction of the machine.

6. A spinning machine arrangement according to claim 5, wherein the support guide rollers including guide rollers which are constructed as tension rollers for the conveyor belts and which are held on the creel rods.

7. A spinning machine arrangement according to claim 6, wherein one creel rod respectively is assigned to two rows of cans.

8. A spinning machine arrangement according to claim 6, wherein the crossmembers extend upwards in a V-shape starting from the creel mast.

9. A spinning machine arrangement according to claim 8, wherein the supports contribute to the supporting of the platform.

10. A spinning machine arrangement to claim 5, wherein the crossmembers extend upwards in a V-shape starting from the creel mast.

11. A spinning machine arrangement according to claim 5, wherein the creel mast is provided with centering devices for the cans of the rows facing it.

12. A spinning machine arrangement according to claim 1, wherein the support contributes to the supporting of the platform.

13. A spinning machine arrangement according to claim 1, wherein the support extends through the platform in the area of the spinning machine center plane.

14. A spinning machine arrangement according to claim 13, wherein each conveyor belt is configured to guide two slivers from a respective can to a respective spinning station.

15. A spinning machine arrangement according to claim 1, wherein the spinning stations are ring spinning stations.

16. A spinning machine arrangement according to claim 15, wherein each of the ring spinning stations includes a three roller drafting unit to which the sliver is feed by the sliver guiding apparatus.

17. A spinning machine arrangement according to claim 1, further comprising a driving roller for the at least one conveyor belt, said driving roller being spaced from a plurality of the support guide rollers along the travel path of the at least one conveyor belt.

18. A spinning machine comprising:

spinning stations arranged on both sides of the machine for the spinning of yarns from slivers, sliver supply cans set up in several rows on a platform above the spinning machine, and guiding devices being provided between the sliver supply cans and the spinning stations which guide the slivers and include a delivery device and are at least partially arranged on a support which is held on the spinning machine and extends upwards through the platform in the area of the center plane of the spinning machine, wherein the delivery device comprises a conveyor belt which guides at least one sliver from the pertaining can to the spinning station, wherein several spinning stations are combined to a machine section, wherein a support is provided between two machine sections respectively on which support guiding rollers of the conveyor belt are held, wherein the conveyor belts have a substantially horizontal section and a substantially vertical section, and wherein deflecting rollers are provided at the transition point of the two sections, which deflecting rollers extend along a machine section and which are disposed on two creel masts.

19. A spinning machine comprising:

spinning stations arranged on both sides of the machine for the spinning of yarns from slivers, sliver supply cans set up in several rows on a platform above the spinning machine, and guiding devices being provided between the sliver supply cans and the spinning stations which guide the slivers and include a delivery device and are at least partially arranged on a support which is held on the spinning machine and extends upwards through the platform in the area of the center plane of the spinning machine, wherein the delivery device comprises a conveyor belt which guides at least one sliver from the pertaining can to the spinning station, wherein several spinning stations are combined to a machine section, wherein a support is provided between two machine sections respectively on which support guiding rollers of the conveyor belt are held, wherein the support has a vertical creel mast, wherein a crossmember is fastened at the upper end of the creel mast which extends in the direction of each machine side, the crossmembers of several creel masts being connected by creel roads extending in the longitudinal direction of the machine, wherein the creel mast is provided with centering devices for the cans of the row facing it, and wherein the centering devices are protective planks for the conveyor belts.

20. A spinning machine comprising:

spinning stations arranged on both sides of the machine for the spinning of yarns from slivers, sliver supply cans set up in several rows on a platform above the spinning machine, and guiding devices being provided between the sliver supply cans and the spinning stations which guide the slivers and include a delivery device and are at least partially arranged on a support which is held on the spinning machine and extends upwards through the platform in the area of the center plane of the spinning machine, wherein the delivery device comprises a conveyor belt which guides at least one sliver from the pertaining can to the spinning station, wherein several spinning stations are combined to a machine section, wherein a support is provided between two machine sections respectively on which support guiding rollers of the conveyor belt are held, wherein the support has a vertical creel mast, wherein a crossmember is fastened at the upper end of the creel mast which extends in the direction of each machine side, the crossmembers of several creel masts being connected by creel roads extending in the longitudinal direction of the machine, and wherein the conveyor belts have a substantially horizontal section and a substantially vertical section, and wherein deflecting rollers are provided at the transition point of the two sections, which deflecting rollers extend along a machine section and which are disposed on two creel masts.

21. A spinning machine according to claim 20, wherein one creel rod respectively is assigned to two rows of cans.

22. A spinning machine according to claim 21, wherein the creel mast is provided with centering devices for the cans of the rows facing it.

23. A spinning machine according to claim 22, wherein the centering devices are protective planks for the conveyor belts.

* * * * *